US011612919B2

(12) United States Patent
Wang et al.

(10) Patent No.: US 11,612,919 B2
(45) Date of Patent: Mar. 28, 2023

(54) FLEXIBLE SKEW ROLLING MILL WITH DUAL-ROTATABLE-SHAFTS

(71) Applicant: UNIVERSITY OF SCIENCE AND TECHNOLOGY BEIJING, Beijing (CN)

(72) Inventors: Baoyu Wang, Beijing (CN); Longfei Lin, Beijing (CN); Shuai Wang, Beijing (CN); Cuiping Yang, Beijing (CN); Shengqiang Liu, Beijing (CN); Huibo Zhang, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 349 days.

(21) Appl. No.: 16/906,729

(22) Filed: Jun. 19, 2020

(65) Prior Publication Data

US 2020/0398323 A1 Dec. 24, 2020

(30) Foreign Application Priority Data

Jun. 20, 2019 (CN) ..... 201910538320.5

(51) Int. Cl.
*B21B 13/00* (2006.01)
*B21B 31/22* (2006.01)
*B21B 31/18* (2006.01)

(52) U.S. Cl.
CPC ..... *B21B 13/008* (2013.01); *B21B 31/185* (2013.01); *B21B 31/22* (2013.01)

(58) Field of Classification Search
CPC ..... B21B 13/008; B21B 13/02; B21B 13/023; B21B 31/18; B21B 31/185; B21B 31/20; B21B 31/22; B21B 31/32
See application file for complete search history.

(56) References Cited

FOREIGN PATENT DOCUMENTS

CN 200995226 12/2007
CN 200995226 Y * 12/2007
(Continued)

*Primary Examiner* — Debra M Sullivan
(74) *Attorney, Agent, or Firm* — Grossman, Tucker, Perreault & Pfleger, PLLC

(57) ABSTRACT

Metal plastic forming processes and equipment that provides a flexible skew rolling mill with dual-rotatable-shafts, including a base unit, a guide unit, two rollers, two servo main-shaft systems, a roller distance adjusting mechanism, two tilt angle adjusting mechanisms, a cooling system and a numerical control system. The two servo main-shaft systems are mounted under the support of the two beds, thereby driving the two rollers to do rotation motion; the roller distance adjusting mechanism drives the two beds, thereby enabling the two rollers to do synchronous centering and radial feed motion; the two tilt angle adjusting mechanisms drive the servo main-shaft systems respectively to rotate around a horizontal rolling center line and enable the two rollers to do tilt angle adjustment motion; and the numerical control system controls a rotating speed, radial feed and tilt angle adjustment of the two rollers, such that skew rolling mills and rollers of the same dimensions and specification can form shaft parts of different dimensions and specifications by flexible skew rolling. The flexible skew rolling mill with dual-rotatable-shafts has the advantages that the beds are synchronously centered and radial feed, the strength of the beds is high, the mounting and debugging are convenient, flexible production can be realized and the like such that the flexible skew rolling mill has broad prospects of being applied to the field of forming large-diameter shaft parts with diversified specifications.

9 Claims, 7 Drawing Sheets

(56) References Cited

FOREIGN PATENT DOCUMENTS

| | | | | |
|---|---|---|---|---|
| CN | 102581011 | | 7/2012 | |
| CN | 103624498 | | 3/2014 | |
| CN | 204182678 | | 3/2015 | |
| CN | 108453130 | | 8/2018 | |
| CN | 110102575 | | 8/2019 | |
| DE | 10349056 | | 5/2005 | |
| RU | 2170152 | C2 * | 7/2001 | ..... B21B 13/008 |

* cited by examiner

FLEXIBLE SKEW ROLLING MILL WITH DUAL-ROTATABLE-SHAFTS

FIELD

The present disclosure relates to the technical field of metal plastic forming processes and equipment, and in particular relates to a flexible skew rolling mill with dual-rotatable-shafts.

BACKGROUND

As one of the key parts of major equipment, a large shaft part is used for power transfer and motion implementation of large-scale equipment. Generally, the large shaft part is used for bearing combined load like bending, torsion, impact and vibration, etc. under a high-speed and heavy-load work condition, resulting in direct influence of its production cost, forming precision, performance and quality on performance of key equipment in such industries as aviation and aerospace, rail transit, heavy machinery and military equipment. Therefore, it is the precondition for developing manufacturing industry of large advanced equipment.

At present, the large shaft part is formed mainly firstly, by employing free forging and fast forging, which do not require design of a special die, resulting in high flexibility in production, whereas the process has such problems as low production efficiency, low product precision, low automation degree and poor stability of product quality, which restrict production of such high quality shaft parts; secondly, by using radial forging, which is featured by high precision, so that it is the main method for forming such large shaft parts currently, whereas the method has the problems as follows: the structure of the forming device is complicated, it is difficult to mater the manufacturing and maintenance techniques, the device is expensive and obtained substantially depending on import, etc.; and thirdly by adopting cross wedge rolling forming, with which precise forming can be realized at high efficiency by researching and developing a product die, whereas due to characteristics that dimensions of the die are large, the cost for processing is high and flexible production cannot be realized, the method is mainly applied to forming processes of middle- and small-sized shafts at large batches currently, while being applied less to large shafts.

As dimensions of the shaft parts become large, specifications diversified and the number in small batches, it seems particularly vital to realize "one device doing more" and "small device doing more important" through flexible manufacturing. The patent application of team with the title of "shaft part two-roller flexible skew rolling forming device and method (with an application number of 201910362201.9) provides a forming processes and principle apparatus for flexible skew rolling of the shaft parts, while a specific engineering device is not invented.

At present, there are mainly a frame type, a machine tool type and a clamp type for skew rolling mills with similar structures. However, the following problems exist for them: firstly, flexible forming of the device cannot be realized, resulting in production of products in a single specification only; secondly, automatic degree is low, and debugging of the device is complicated; and thirdly dimensions for a complete machine are large, and manufacturing cost is high.

SUMMARY

The objective of the present disclosure is to overcome defects of the prior art and provides a flexible skew rolling mill with dual-rotatable-shafts. With the adoption of a dual-rotatable-shafts structure, rotation motion, radial feed motion and tilt angle adjustment motion of two rollers are controlled by a numerical control system, such that the skew rolling mills and dies of the same specifications can flexibly form shaft parts of different dimensions and specifications.

The present disclosure adopts the following technical solutions:

a flexible skew rolling mill with dual-rotatable-shafts, including a base unit, a guide unit, two rollers, two servo main-shaft systems, a roller distance adjusting mechanism, two tilt angle adjusting mechanisms and a numerical control system;

the two rollers can do roller rotation motion rotating around the axes of the rollers, linear motion in the billet radial direction and tilt angle adjustment motion for adjusting the included angles between the axes of the rollers and the axis of the billet;

the guide unit is configured to limit the rotation of the billet between the two rollers for preventing swing of the billet;

the two servo main-shaft systems are configured to drive the two rollers to rotate around the axes of the rollers;

the roller distance adjusting mechanism is configured to drive the two rollers to do linear motion in the radial direction of the billet;

the two tilt angle adjusting mechanisms are configured to drive the two rollers to adjust the included angles between the axes of the rollers and the axis of the billet;

the numerical control system is configured to control the two servo main-shaft systems, the roller distance adjusting mechanism and the two tilt angle adjusting mechanisms; and the base unit is configured to mount the flexible skew rolling mill.

Further, the two servo main-shaft systems, the roller distance adjusting mechanism and the two tilt angle adjusting mechanisms are all disposed on the two beds;

the two beds are symmetrically arranged with the axis of the billet as the center, each of the beds is supported by a bed rotatable shaft, and the beds are capable of rotating around the bed rotatable shafts;

holes for mounting the bed rotatable shafts are formed in the lower ends of the beds, holes for mounting the two servo main-shaft systems are disposed in the middle of the beds, holes for mounting the roller distance adjusting mechanism are formed in the upper ends of the beds, and holes for mounting worms of the tilt angle adjusting mechanisms are formed in the rear ends of the beds.

Further, the two beds are both of "L"-shaped semi-circular-arc bed structures.

Further, the lower parts of the two beds are provided with gear synchronizing mechanisms which are two gears and are respectively disposed at the end parts of the two bed rotatable shafts; the two gears are externally engaged, and when the two gears are engaged to rotate, the two beds are driven to do opposite-direction rotation at the same speed around the bed rotatable shafts.

Further, the two servo main-shaft systems include two sets of same components, and each set of components includes a main shaft, a servo main motor, a decelerator and a main-shaft bearing seat; the two main shafts are symmetrically arranged with the axis of the billet as the center; the rollers are mounted on the main shafts, the main shafts are supported on the main-shaft bearing seats, and the main-shaft bearing seats are supported on the beds, and are fit-mounted at the middle of the beds by virtue of the holes for mounting the main-shaft systems; and the two servo main motors respectively drive the two main shafts to rotate by virtue of the decelerators, thus driving the two rollers to do same-direction rotation motion.

Further, the roller distance adjusting mechanism includes two cylinder block seats and a linear cylinder; the axis of the roller distance adjusting mechanism is perpendicular to the axes of the bed rotatable shafts;

the linear cylinder is mounted under the support of the two cylinder block seats, the two cylinder block seats are respectively fixed at the upper parts of the two beds in the manner that locking nuts pass through the holes for mounting the roller distance adjusting mechanism; and the linear cylinder is a hydraulic cylinder or an electric cylinder; and the linear cylinder drives the two cylinder block seats to do linear motion, thereby driving the two beds to rotate around the respective bed rotatable shafts so as to enable the two rollers to do opposite-direction radial feed motion at the same speed.

Further, the two tilt angle adjusting mechanisms include two sets of same components, and each set of components includes a tilt angle adjusting motor, a worm wheel and a worm;

the two worms are fixedly mounted at the rear sides of the two beds respectively by virtue of the holes for mounting the worms, and the two worm wheels are fixedly mounted at the sides, close to the worms, of the two main-shaft bearing seats respectively by virtue of bolts; and the tilt angle adjusting motors drive the worms to rotate, thereby enabling the worms to transfer the motion to the worm wheels, so as to drive, by the worm wheels, the two servo main-shaft systems to perform interlaced rotation around a horizontal rolling center line (a connecting line for geometric centers of the two rollers), and enable the two rollers to do opposite-direction tilt angle adjustment motion.

Further, the base unit includes a fixing frame, a base, a bed rotatable shaft seat and a bed rotatable shaft cover;

the fixing frame is mounted on a foundation, the base is fixedly mounted on the fixing frame, the bed rotatable shaft seat is fixedly mounted on the base, the bed rotatable shaft cover is fixed on the bed rotatable shaft seat by virtue of threads, the bed rotatable shaft seat and the bed rotatable shaft cover are upper and lower split seats of the bed rotatable shafts, and the holes for mounting the bed rotatable shafts are processed in the bed rotatable shaft seat and the bed rotatable shaft cover with the axis of the billet as a symmetry center.

Further, the guide unit includes a feeding guide cylinder, a middle guide plate and a discharging guide cylinder;

the feeding guide cylinder is fixedly mounted at the front of the upper side of the bed rotatable shaft cover, the middle guide plate is fixedly mounted at the middle of the upper side of the bed rotatable shaft cover, the discharging guide cylinder is fixedly mounted at the rear of the upper side of the bed rotatable shaft cover; and the axis of the billet coincides with the axes of the feeding guide cylinder and the discharging guide cylinder.

Further, the flexible skew rolling mill with dual-rotatable-shafts further includes a cooling system; the cooling system includes a cooling liquid spraying tube, a liquid baffle, a liquid discharging tube and a liquid storage tank; the cooling liquid spraying tube sprays liquid to the two rollers, the liquid baffle is fixedly mounted on the base to prevent the cooling liquid from spilling over; the liquid discharging tube is fixedly mounted under the base to discharge the cooling liquid; and the water tank is arranged within the fixing frame for storing the cooling liquid.

Further, the numerical control system includes a control cabinet component and a screen display component; and the control cabinet component is fixedly mounted within the fixing frame, and the screen display component is mounted at the front side of the right bed.

The present disclosure has the beneficial effects as follows:

1. With the adoption of a dual-rotating-shaft type structure, the overall structure is stabler; and during radial feed, the offset of the horizontal rolling center line is small.
2. With the adoption of the gear synchronizing mechanisms, the effect that two beds are centered and pressed down synchronously is realized by the single cylinder, and the vertical center line of the skew rolling mill does not offset.
3. With the adoption of the "L"-shaped semi-circular-arc bed structure, the stress line is short, and the strength of the beds is high.
4. The operating state of the device is adjusted by the numerical control system, resulting in convenient mounting and debugging.
5. The cooling system is arranged, so that the service life of the rollers is longer, and the cooling liquid can be recycled, resulting in a better work environment.
6. With the adoption of driving by the main-shaft servo systems, the dimensions of a complete machine are greatly reduced.
7. Shaft parts of different dimensions and specifications can be formed, thereby realizing flexible production.
8. The flexible skew rolling mill has the advantages that the beds are synchronously centered and pressed down, the strength of the beds is high, the mounting and debugging are convenient, flexible production can be realized and the like such that the flexible skew rolling mill has broad prospects of being applied to the field of forming large-diameter shaft parts in middle and small batches.

Figure 1:
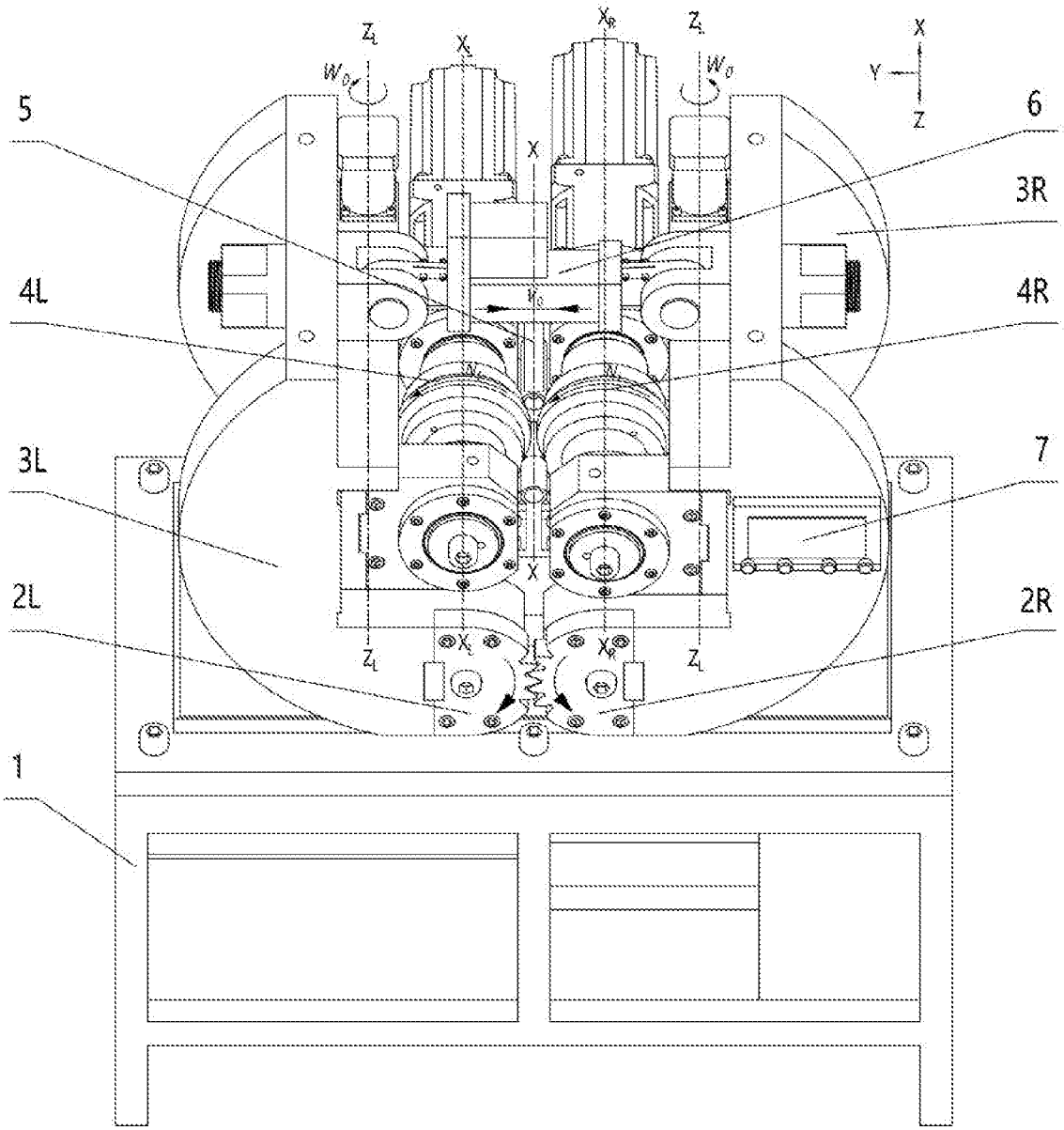
FIG. 1 is an overall structure schematic diagram of a flexible skew rolling mill with dual-rotatable-shafts in an embodiment of the present disclosure.

In the drawings, 0—billet, 1—fixing frame, 2L—left synchronizing gear, 2R—right synchronizing gear, 3L—left bed, 3R—right bed, 4L—left roller, 4R—right roller, 5—cooling liquid spraying tube, 6—linear cylinder, 7—screen display component, 8—liquid storage tank, 9—base, 10—liquid baffle, 11—liquid discharging tube, 12—feeding guide cylinder, 13—middle guide plate, 14—discharging guide cylinder, 15—bed rotatable shaft cover, 16—bed rotatable shaft seat, 17—control cabinet component, 18L—left bed rotatable shaft, 18R—right bed rotatable shaft, 19—main-shaft bearing seat, 20—main shaft, 21—decelerator, 22—servo motor, 23—locking nut, 24—cylinder block seat, 25—thread bushing, 26—pre-tightening bolt, 27—tilt angle adjusting motor, 28—worm, and 29—worm wheel.

X-X—axis of billet, axis of feeding cylinder, and axis of discharging cylinder; $X_L$-$X_L$—axis of left main-shaft servo system and axis of left roller; $X_R$-$X_R$—axis of right main-shaft servo system and axis of right roller; $X'_L$-$X'_L$—axis of left bed rotatable shaft and axis of left gear set; axis of right bed rotatable shaft and axis of right gear set; Y-Y—horizontal rolling center line of skew rolling mill, axis of worm wheel, and axis of main-shaft bearing seat; $Z_L$-$Z_L$—axis of worm; A—hole for mounting bed rotatable shaft; B—hole for mounting servo main-shaft system; C—hole for mounting radial feed device; D—hole for mounting worm; $V_0$—stretching and contracting speed of linear cylinder; $V_1$—radial feed speed of roller; $W_0$—rotating speed of worm; $W_1$—rotating speed of worm wheel, rotating speed of main-shaft bearing seat and rotating speed of tilt angle adjustment motion of roller; and $N_1$—rotating speed of roller.

DETAILED DESCRIPTION

Specific embodiments of the present disclosure will be described in detail below in conjunction with accompanying figures. It should be noted that the technical features or combinations thereof described in the following embodiments should not be deemed as isolated and they may be mutually combined so as to achieve a better technical effect.

In the embodiments described below, for convenient statement, the two servo main-shaft systems are stated as a left servo main-shaft system and a right servo main-shaft system; the two tilt angle adjusting mechanisms are stated as a left tilt angle adjusting mechanism and a right tilt angle adjusting mechanism; the two main shafts are stated a left main shaft and a right main shaft; the two beds are stated as a left bed and a right bed; the two bed rotatable shafts are stated as a left bed rotatable shaft and a right bed rotatable shaft; the two gears are stated a left gear and a right gear;

and the two rollers are stated as a left roller and a right roller, etc. It should be noted that distinguishing by left and right herein is merely distinguishing of relative positions and it can also be distinguishing by up and down. The protection scope should not be defined based on the contents of the embodiments.

As shown in FIGS. 1-8, an embodiment of the present disclosure provides a flexible skew rolling mill with dual-rotatable-shafts, including a base unit, a guide unit, two rollers (a left roller and a right roller), two beds (a left bed and a right bed), two bed rotatable shafts (a left bed rotatable shaft and a right bed rotatable shaft), two servo main-shaft systems (a left servo main-shaft system and a right servo main-shaft system), a roller distance adjusting mechanism, two tilt angle adjusting mechanisms (a left tilt angle adjusting mechanism and a right tilt angle adjusting mechanism), a numerical control system, a gear synchronizing mechanism and a cooling system.

Figure 2:
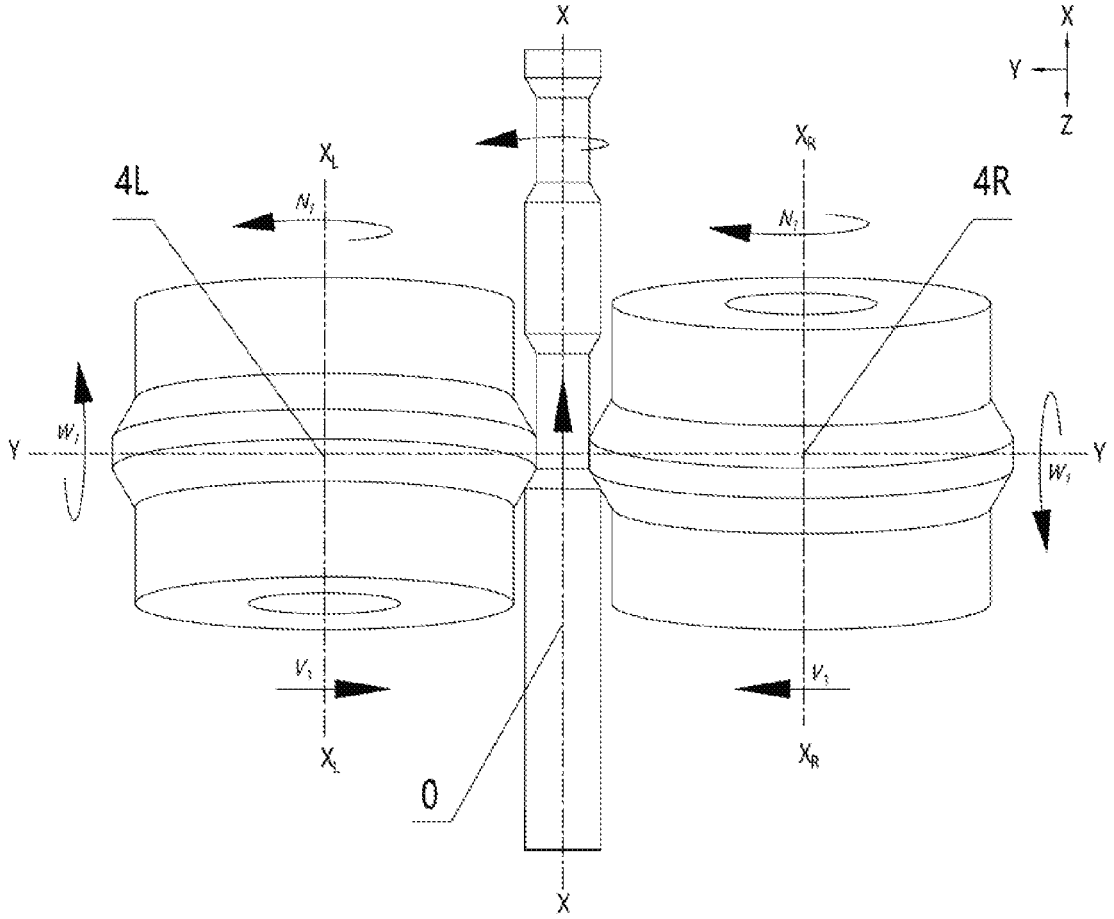
FIG. 2 is a position relation and motion state schematic diagram of two rollers and a billet.

As shown in FIGS. 1 and 2, the numerical control system controls the two servo main-shaft systems, the roller distance adjusting mechanism and the two tilt angle adjusting mechanisms in real time, the effect that the two rollers (4L, 4R) are synchronously centered and pressed down is realized by the gear synchronizing mechanism, and the two rollers (4L, 4R) can do dynamically adjustable same-direction rotation motion at a rotating speed of $N_1$, opposite-direction radial feed motion at a speed of $V_1$ and opposite-direction tilt angle adjustment motion at a rotating speed of $W_1$. Process parameters $N_1$, $V_1$ and $W_1$ of the skew rolling mill are dynamically adjustable. Therefore, the skew rolling mills of the same dimensions and specifications can form shaft parts of different dimensions and specifications by flexible skew rolling.

Figure 3:
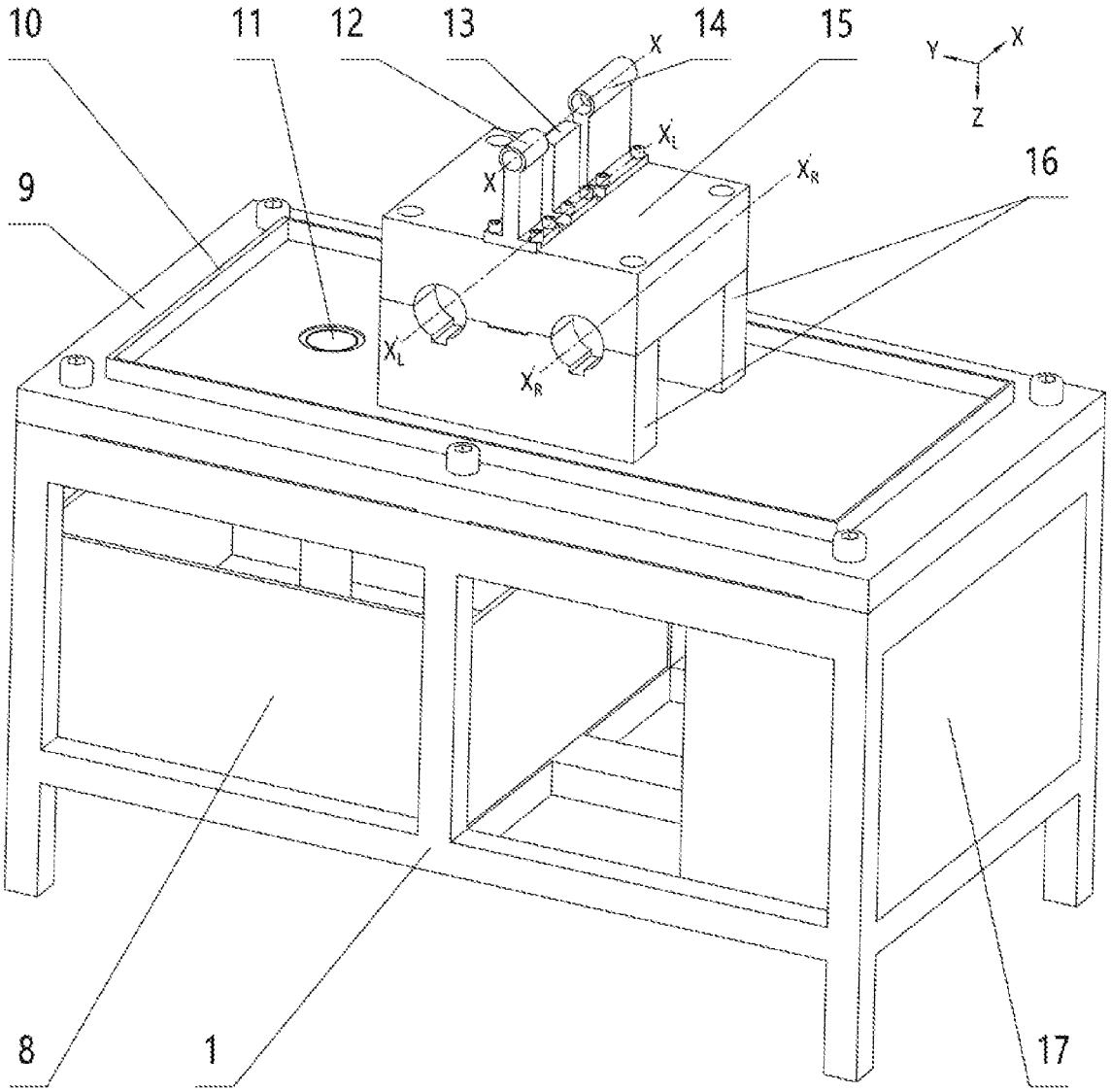
FIG. 3 is a structure schematic diagram of a base unit in an embodiment.

Preferably, as shown in FIGS. 1 and 3, the base unit includes a fixing frame 1, a base 9, a bed rotatable shaft seat 16 and a bed rotatable shaft cover 15, wherein the fixing frame 1 is mounted on a foundation, the base 9 is fixedly mounted on the fixing frame 1, the bed rotatable shaft seat 16 is fixedly mounted on the base 9, and the bed rotatable shaft cover 15 is fixed on the bed rotatable shaft seat 16 by virtue of threads. The bed rotatable shaft seat 16 and the bed rotatable shaft cover 15 are upper and lower split seats of the bed rotatable shafts, and holes for mounting bed rotatable shafts are symmetrically processed in the bed rotatable shaft seat 16 and the bed rotatable shaft cover 15 about the axis X-X of the billet.

Preferably, as shown in FIGS. 1 and 3, the guide unit includes a feeding guide cylinder 12, a middle guide plate 13 and a discharging guide cylinder 14, wherein the feeding guide cylinder 12 is fixedly mounted at the front of the upper side of the bed rotatable shaft cover 15, the middle guide plate 13 is fixedly mounted at the middle of the upper side of the bed rotatable shaft cover 15, and the discharging guide cylinder 14 is fixedly mounted at the rear of the upper side of the bed rotatable shaft cover 15. The axis X-X of the billet coincides with the axes of the feeding guide cylinder 12 and the discharging guide cylinder 14. The guide unit is used for preventing swing of a billet 0 and limiting the rotation of the billet 0 between the two rollers (4L, 4R).

Figure 4:
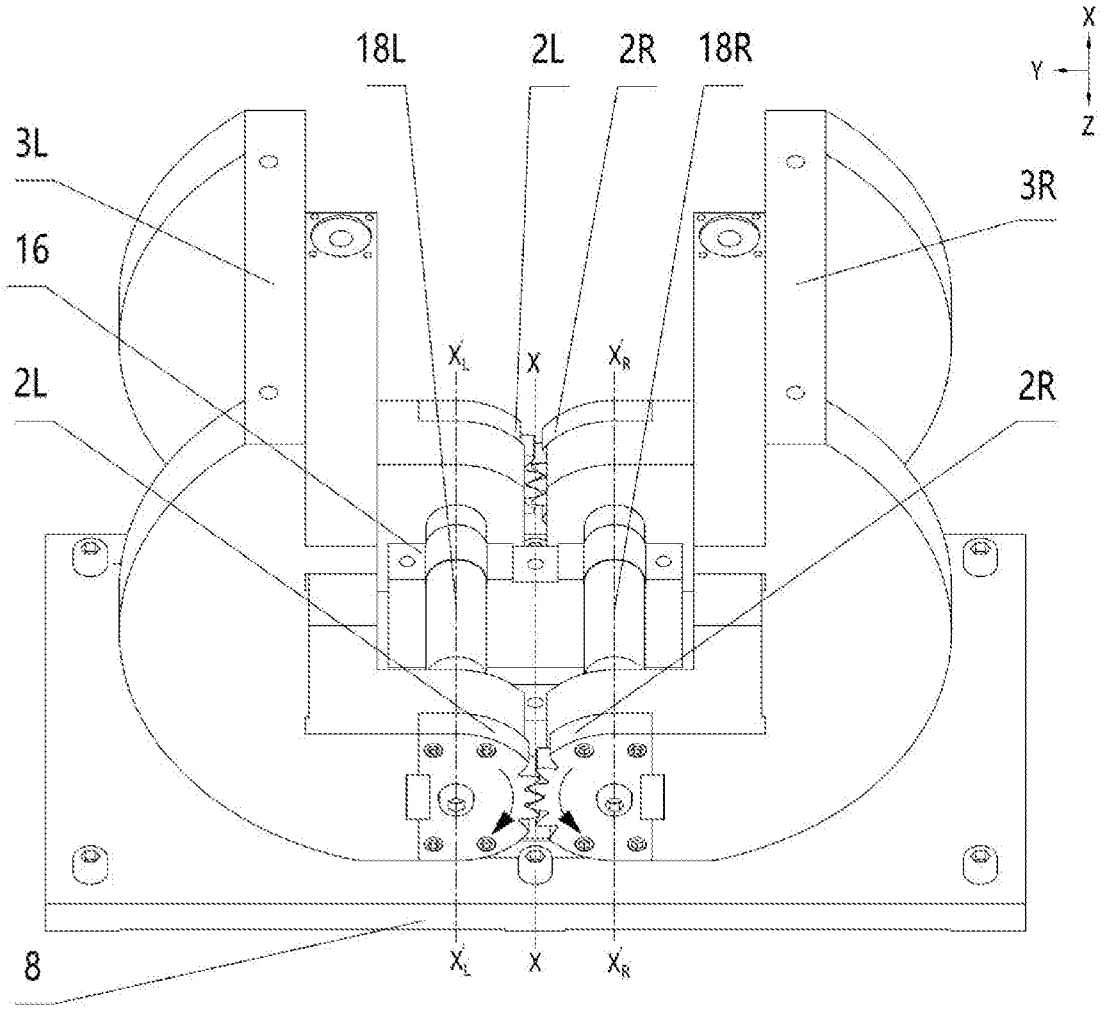
FIG. 4 is a structure schematic diagram of a base, gear synchronizing mechanisms, two rotatable shafts and two beds in an embodiment.

As shown in FIG. 4, the two bed rotatable shafts (18L 18R) are the same in geometric dimensions, are symmetrically arranged about the axis X-X of the billet and are mounted under the support of the bed rotatable shaft seat 16 and the bed rotatable shaft cover 15. Preferably, the bed is of an "L"-shaped semi-circular-arc bed structure, so that the stress line is short and the strength of the beds is high.

Figure 5:
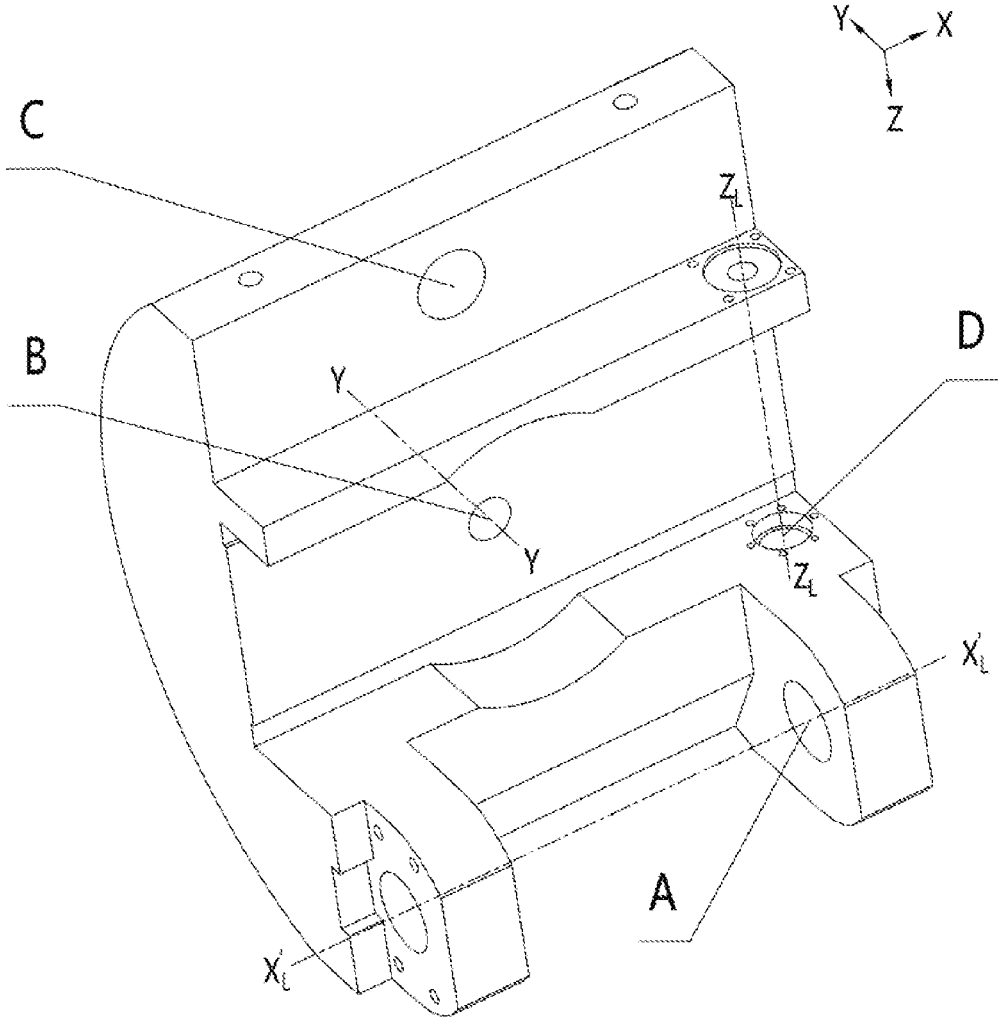
FIG. 5 is a structure schematic diagram of a left bed in an embodiment.

As shown in FIGS. 4 and 5, the two beds (3L, 3R) are the same in geometric dimensions, are symmetrically arranged about the axis X-X of the billet and are respectively mounted on the two bed rotatable shafts (18L, 18R). The axes ($X'_L$-$X'_L$, $X'_R$-$X'_R$) of the holes for mounting two bed rotatable shafts respectively coincide with the axes ($X'_L$-$X'_L$, $X'_R$-$X'_R$) of the two rotatable shafts, and the two beds (3L, 3R) can respectively rotate around the two bed rotatable shafts (18L, 18R). Preferably, the beds (3L, 3R) are "L"-shaped semi-circular-arc beds, the lower ends of the beds are provided with the holes for mounting bed rotatable shafts A, the middle of the beds are provided with holes B for mounting the main-shaft servo systems, the upper ends of the beds are provided with holes for mounting the roller distance adjusting mechanism C, and the rear sides of the beds are provided with holes D for mounting worms.

As shown in FIGS. 1 and 4, the gear synchronizing mechanisms are mounted under the two beds (3L, 3R), include a left gear 2L and a right gear 2R, and are both fixedly mounted on the beds (3L, 3R) by bolts. The axis of the left gear 2L coincides with the axis $X'_L$-$X'_L$ of the left rotatable shaft, the axis of the right gear 2R coincides with the axis $X'_R$-$X'_R$ of the right rotatable shaft, and the left gear 2L and the right gear 2R are externally engaged with each other. When the two beds (3L, 3R) rotate around the two bed rotatable shafts (18L, 18R) respectively, engaging by the gears ensures synchronous opposite-direction rotation, thus ensuring that the vertical center line of the skew rolling mill does not offset.

Figure 6:
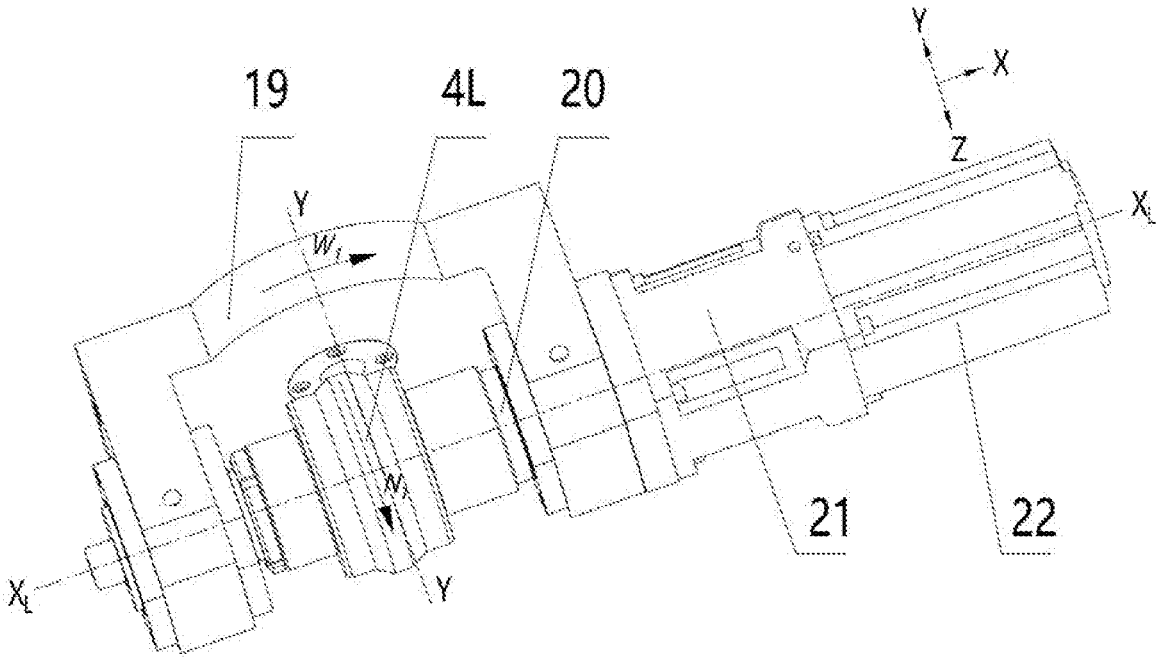
FIG. 6 is a structure and relative motion schematic diagram of a left servo main-shaft system in an embodiment.
Figure 8:
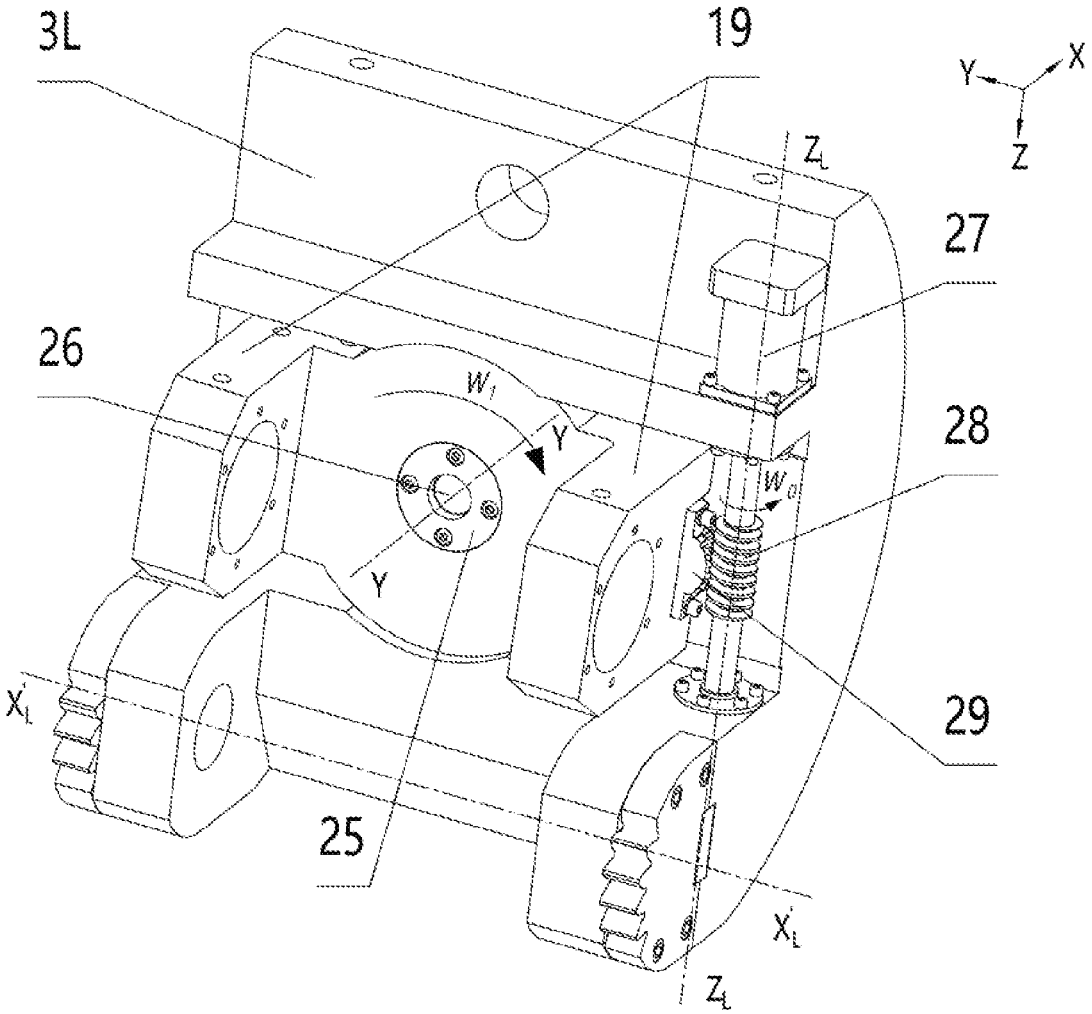
FIG. 8 is a structure and relative motion schematic diagram of a left tilt angle adjusting mechanism, a left bed and main-shaft bearing seats in an embodiment.

Preferably, as shown in FIGS. 1, 6 and 8, the two servo main-shaft systems are the same in geometric dimensions and are mounted under the support of the holes B for mounting the main-shaft servo systems of the two beds respectively. The two servo main-shaft systems can do rotation motion around the horizontal rolling center line Y-Y. Each servo main-shaft system includes a main shaft 20, a servo motor 22, a decelerator 21, a main-shaft bearing seat 19, a thread bushing 25 and a pre-tightening bolt 26. The thread bushings 25 are fixedly mounted on the two beds (3L, 3R), and the main-shaft bearing seats 19 are supported and mounted on the holes B for mounting the main-shaft servo systems by thread fit of the pre-tightening bolts 26 and the thread bushings 25. The servo motors 22 drive the two main shafts 20 to rotate respectively, thus enabling the two rollers (4L, 4R) to do same-direction rotation motion at a rotating speed of $N_1$.

Figure 7:
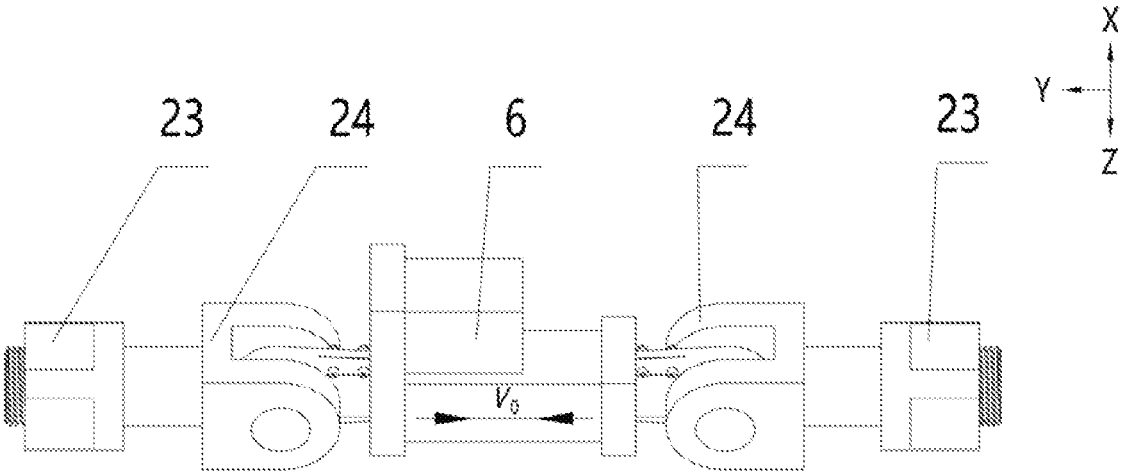
FIG. 7 is a structure and relative motion schematic diagram of a roller distance adjusting mechanism in an embodiment.

Preferably, as shown in FIGS. 1 and 7, the roller distance adjusting mechanisms are mounted on the two beds (3L, 3R), and include two cylinder block seats 24, a linear cylinder 6 and two locking nuts 23. The two cylinder block seats 24 are mounted under the support of the holes C for mounting the roller distance adjusting mechanism of the two beds and are fixed by the two locking nuts 23; and the linear cylinder 6 is mounted under the support of the two cylinder block seats 24. The linear cylinder 6 drives the roller distance adjusting mechanism to do linear motion, thereby driving the two beds (3L, 3R) to rotate around the axes ($X'_L$-$X'_L$, $X'_R$, $X'_R$) of the two rotatable shafts respectively, such that the two rollers (4L, 4R) can do opposite-direction radial feed motion at a speed of $V_1$. The linear cylinder 6 may be a hydraulic cylinder or an electric cylinder.

Preferably, as shown in FIGS. 1 and 8, the two tilt angle adjusting mechanisms are respectively mounted at the rear sides of the two beds (3L, 3R), and each of the two tilt angle adjusting mechanisms includes a tilt angle adjusting motor 27, a worm 28 and a worm wheel 29. The two worms 28 are mounted under the support of the holes D for mounting the worms of the two beds, and the worm wheels 29 are fixedly mounted to the rear sides of the main-shaft bearing seats 19 by bolts. The axes of the two worm wheels coincide with the axes of the holes B for mounting the servo main-shaft systems and the horizontal rolling center line Y-Y. The tilt angle adjusting motors 27 drive the worms 28 to rotate, thereby enabling the worms 28 to transfer the motion to the worm wheels 29, so as to drive, by the worm wheels 29, the two servo main-shaft systems to perform interlaced rotation around the horizontal rolling center line Y-Y, and enable the two rollers (4L, 4R) to do opposite-direction tilt angle adjustment motion at a rotating speed of $W_1$.

Preferably, as shown in FIGS. 1 and 3, the cooling system includes a cooling liquid spraying tube 5, a liquid baffle 10, a liquid discharging tube 11 and a liquid storage tank 8. The cooling liquid spraying tube 5 is fixedly arranged on the left bed 3L for spraying liquid to cool the two rollers (4L, 4R). The liquid baffle 10 is fixedly mounted on the base 9 for preventing the cooling liquid from spilling over. The liquid discharging tube 11 is fixedly mounted under the base 9 for discharging the cooling liquid; and the liquid storage tank 8 is fixedly mounted within the fixing frame 1 for storing the cooling liquid.

Preferably, as shown in FIGS. 1 and 3, the numerical control system includes a control cabinet component 17 and a screen display component 7. The control cabinet component 17 is fixedly mounted within the fixing frame 1, and the screen display component 7 is mounted at the front side of the right bed 3R. The motion state of the servo motors 22, the linear cylinder 6 and the tilt angle adjusting motors 27 is controlled by a numerical control program.

The main working steps of the flexible skew rolling mill with dual-rotatable-shafts in the present disclosure are as follows:

1. Program design of the numerical control system: designing a numerical control system program to control the motion state of the servo motors 22, the linear cylinder 6 and the tilt angle adjusting motors 27 according to the dimensions of the billet 0 and the shaft parts.
2. Heating and transfer of the billet 0: heating the billet 0 to a rolling temperature (room temperature for cold rolling and the temperature of 700 DEG to 1300 DEG for hot rolling), and transferring the heated billet 0 into the skew rolling mill.
3. Program call of the numerical control system: calling the numerical control program of the numerical control system for controlling process parameters $N_1$, $V_1$ and $W_1$ to perform flexible skew rolling forming on the billet 0.

The working principle of the present disclosure is: the billet 0 heated to the rolling temperature is transferred into the skew rolling mill, the motion of the two servo motors 22, the linear cylinder 6 and the two tilt angle adjusting motors 28 is controlled by the numerical control program to drive the two rollers (4L, 4R) to do dynamically adjustable rotation motion, radial feed motion and tilt angle adjustment motion, and the two rollers (4L, 4R) are controlled by the gear synchronizing mechanisms to be synchronously centered and pressed down. Thus by designing different numerical control programs through programming, the skew rolling mills and the two rollers (4L, 4R) of the same dimensions and specifications can form shaft parts of different dimensions and specifications by flexible skew rolling.

The flexible skew rolling mill with dual-rotatable-shafts has the advantages that the beds are synchronously centered and pressed down, the strength of the beds is high, the mounting and debugging are simple, flexible production can be realized and the like such that the flexible skew rolling mill has broad prospects of being applied to the field of forming large-diameter shaft parts in middle and small batches.

Although a plurality of embodiments of the present disclosure have been provided in the text, those skilled in the art should understand that embodiments in the text can be modified without departing from the spirit of the present disclosure. The above embodiments are merely exemplary, such that the range of the claims in the present application should not be defined based on embodiments of the text.

What is claimed is:

1. A flexible skew rolling mill with dual-rotatable-shafts, comprising:

a base unit;

a guide unit;

two rollers;

two servo main-shaft systems;

a roller distance adjusting mechanism; and two tilt angle adjusting mechanisms and a numerical control system, the two rollers can do roller rotation motion that rotate around the axes of the rollers, linear motion in a radial direction of a billet and tilt angle adjustment motion for adjusting angles between the axes of the rollers and an axis of the billet;

the guide unit is configured to limit the rotation of the billet between the two rollers for preventing swing of the billet;

the two servo main-shaft systems are configured to drive the two rollers to rotate around the axes of the rollers;

the roller distance adjusting mechanism is configured to drive the two rollers to do linear motion in the radial direction of the billet, and the roller distance adjusting mechanism comprises a linear cylinder;

the two tilt angle adjusting mechanisms are configured to drive the two rollers to adjust the included angles between the axes of the rollers and the axis of the billet;

the numerical control system is configured to control the two servo main-shaft systems, the roller distance adjusting mechanism and the two tilt angle adjusting mechanisms; and the base unit is configured to mount the flexible skew rolling mill;

wherein the two servo main-shaft systems, the roller distance adjusting mechanism and the two tilt angle adjusting mechanisms are all disposed on beds;

the two beds are symmetrically arranged with the axis of the billet as the center, each of the beds is supported by a bed rotatable shaft, and the beds are capable of rotating around the bed rotatable shafts;

holes for mounting the rotatable shafts are formed in the lower ends of the beds, holes for mounting the two servo main-shaft systems are formed in the middle of the beds, holes for mounting the roller distance adjusting mechanism are formed in the upper ends of the beds, and holes for mounting worms of the tilt angle adjusting mechanisms are formed in the rear ends of the beds.

2. The flexible skew rolling mill with dual-rotatable-shafts according to claim 1, wherein the lower parts of the two beds are provided with gear synchronizing mechanisms which are two gears/gear sets and are respectively disposed at the end parts of the two bed rotatable shafts; the two gears/gear sets are externally engaged with each other, and when the two gears/gear sets are engaged to rotate, the two beds are driven to do opposite-direction rotation at the same speed around the rotatable shafts.

3. The flexible skew rolling mill with dual-rotatable-shafts according to claim 2, wherein the roller distance adjusting mechanism further comprises two cylinder block seats;

the linear cylinder is mounted on the two cylinder block seats, and the two cylinder block seats are respectively fixed at the upper parts of the two beds in the manner that locking nuts pass through the holes for mounting the roller distance adjusting mechanism; and the linear cylinder is a hydraulic cylinder or an electric cylinder; and the linear cylinder drives the two cylinder block seats to do linear motion, thereby driving the two beds to rotate around the respective bed rotatable shafts so as to enable the two rollers to do opposite-direction radial linear motion at the same speed.

4. The flexible skew rolling mill with dual-rotatable-shafts according to claim 1, wherein the two servo main-shaft systems comprise two sets of same components, and each set of components comprises a main shaft, a servo main motor, a decelerator and a main-shaft bearing seat;

the two main shafts are symmetrically arranged with the axis of the billet as the center; the rollers are mounted on the main shafts, the main shafts are supported on the main-shaft bearing seats, and the main-shaft bearing seats are supported on the beds, and are fit-mounted at the middle of the beds by virtue of the holes for mounting the main-shaft systems; and the two servo main motors respectively drive the two main shafts to rotate by virtue of the decelerators, thus driving the two rollers to do same-direction rotation motion.

5. The flexible skew rolling mill with dual-rotatable-shafts according to claim 1, wherein the two tilt angle adjusting mechanisms comprise two sets of same components, and each set of component comprises a tilt angle adjusting motor, a worm wheel and a worm;

the two worms are fixedly mounted at the rear sides of the two beds respectively by virtue of the holes for mounting the worms, and the two worm wheels are fixedly mounted at the sides, close to the worms, of the two main-shaft bearing seats respectively by virtue of bolts; and the tilt angle adjusting motors drive the worms to rotate, thereby enabling the worms to transfer the motion to the worm wheels, so as to drive, by the worm wheels, the two servo main-shaft systems to perform interlaced rotation around a horizontal rolling center line, and enable the two rollers to do opposite-direction tilt angle adjustment motion.

6. The flexible skew rolling mill with dual-rotatable-shafts according to claim 1, wherein the base unit comprises a fixing frame, a base, a bed rotatable shaft seat and a bed rotatable shaft cover; the fixing frame is mounted on a foundation, the base is fixedly mounted on the fixing frame, the bed rotatable shaft seat is fixedly mounted on the base, the bed rotatable shaft cover is fixed on the bed rotatable shaft seat by virtue of a thread, the bed rotatable shaft seat and the bed rotatable shaft cover are upper and lower split seats of the bed rotatable shafts, and the holes for mounting the bed rotatable shafts are provided in the bed rotatable shaft seat and the bed rotatable shaft cover with the axis of the billet as a symmetry center.

7. The flexible skew rolling mill with dual-rotatable-shafts according to claim 6, wherein the guide unit comprises a feeding guide cylinder, a middle guide plate and a discharging guide cylinder;

the feeding guide cylinder is fixedly mounted at the front of the upper side of the bed rotatable shaft cover, the middle guide plate is fixedly mounted at the middle of the upper side of the bed rotatable shaft cover, and the discharging guide cylinder is fixedly mounted at the rear of the upper side of the bed rotatable shaft cover; and the axis of the billet coincides with the axes of the feeding guide cylinder and the discharging guide cylinder.

8. The flexible skew rolling mill with dual-rotatable-shafts according to claim 6, wherein the flexible skew rolling mill with dual-rotatable-shafts further comprises a cooling system;

the cooling system comprises a cooling liquid spraying tube, a liquid baffle, a liquid discharging tube and a liquid storage tank; the cooling liquid spraying tube sprays liquid to the two rollers, the liquid baffle is fixedly mounted on the base to prevent the cooling liquid from spilling over; the liquid discharging tube is fixedly mounted under the base to discharge the cooling liquid; and the water tank is arranged within the fixing frame for storing the cooling liquid.

9. The flexible skew rolling mill with dual-rotatable-shafts according to claim 6, wherein the numerical control system comprises a control cabinet component and a screen display component; the control cabinet component is fixedly mounted within the fixing frame, and the screen display component is mounted at the front side of the right one of the two beds.

* * * * *